US008512053B2

(12) United States Patent
Worth et al.

(10) Patent No.: US 8,512,053 B2
(45) Date of Patent: Aug. 20, 2013

(54) CABLE SYSTEM WITH INTEGRATED ADAPTOR

(75) Inventors: Cory Worth, Irvine, CA (US); Sandro D. Klein, Irvine, CA (US); Paul D. Osborne, Mill Valley, CA (US); Jonathan D. Mesh, Alameda, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 13/042,316

(22) Filed: Mar. 7, 2011

(65) Prior Publication Data

US 2012/0231642 A1 Sep. 13, 2012

(51) Int. Cl.
*H01R 25/00* (2006.01)

(52) U.S. Cl.
USPC ..... 439/119; 439/638; 439/502

(58) Field of Classification Search
USPC ..... 439/638–641, 119, 505, 468, 135, 439/136, 149, 504, 488, 483, 491, 498, 502
See application file for complete search history.

(56) References Cited

U.S. PATENT DOCUMENTS

| | | | | | |
|---|---|---|---|---|---|
| 3,275,969 | A | * | 9/1966 | Sheeran | 439/451 |
| D266,559 | S | * | 10/1982 | Gibbs | D13/138.1 |
| 4,707,043 | A | * | 11/1987 | Reed | 439/638 |
| D306,282 | S | * | 2/1990 | Arehart et al. | D13/138.1 |
| D332,937 | S | * | 2/1993 | Priest et al. | D13/138.1 |
| 5,396,684 | A | * | 3/1995 | Yocom | 24/16 PB |
| 5,578,834 | A | * | 11/1996 | Trobridge | 250/551 |
| 5,732,445 | A | * | 3/1998 | Stodolka et al. | 24/16 R |
| 6,050,840 | A | * | 4/2000 | Kowalski et al. | 439/369 |
| 6,394,695 | B1 | * | 5/2002 | Chausset | 403/397 |
| 6,427,290 | B1 | * | 8/2002 | Liu | 24/16 R |
| 6,523,229 | B2 | * | 2/2003 | Severson | 24/16 PB |
| 6,790,077 | B1 | * | 9/2004 | Chen | 439/502 |
| 6,907,615 | B1 | * | 6/2005 | Alexander et al. | 439/502 |
| 6,908,324 | B1 | * | 6/2005 | Morley et al. | 439/218 |
| 7,200,856 | B2 | * | 4/2007 | Perlman | 439/502 |
| 7,223,129 | B1 | * | 5/2007 | Lopez et al. | 439/709 |
| 7,255,567 | B1 | * | 8/2007 | Liao | 439/638 |
| 7,442,077 | B2 | * | 10/2008 | Peress et al. | 439/505 |
| 7,556,535 | B2 | * | 7/2009 | Liao | 439/640 |
| 2003/0207601 | A1 | * | 11/2003 | Adachi | 439/135 |
| 2005/0009404 | A1 | * | 1/2005 | Lee | 439/638 |
| 2005/0079769 | A1 | * | 4/2005 | Strayer | 439/652 |
| 2005/0186854 | A1 | * | 8/2005 | Huang | 439/677 |
| 2006/0073717 | A1 | * | 4/2006 | Ng et al. | 439/131 |
| 2006/0089049 | A1 | * | 4/2006 | Sedor | 439/620 |
| 2006/0152670 | A1 | * | 7/2006 | Esparza | 351/41 |
| 2007/0158158 | A1 | * | 7/2007 | Ameche | 190/108 |
| 2008/0188870 | A1 | * | 8/2008 | Andre et al. | 606/130 |

* cited by examiner

*Primary Examiner* — Briggitte R Hammond
(74) *Attorney, Agent, or Firm* — Patterson & Sheridan, LLP

(57) ABSTRACT

A power cable or data cable system includes an integrated electrical connection adaptor configured to be mechanically coupled to the cable system when not in use. The adaptor is coupled to the cable system using clasping features formed in the body of the adaptor or a tethering element. Thus, the adaptor is conveniently located for use and cannot be lost. In some embodiments, the tethering element serves as a cable management system that enhances portability of the cable system by bundling loops of the cable system together.

8 Claims, 3 Drawing Sheets

CABLE SYSTEM WITH INTEGRATED ADAPTOR

BACKGROUND OF THE INVENTION

1. Field of the Invention

Embodiments of the present invention relate generally to signal and power cable systems and, more specifically, to a cable system with an integrated adaptor.

2. Description of the Related Art

Electronic devices commonly make use of power and data cables as part of normal operation, including computers, smart phones, video cameras, etc. As these devices are miniaturized, the plugs and receptacles of cables that provide power and data connectivity for newer and smaller models are often miniaturized as well, even when the power and data requirements of the miniaturized cables do not change compared to older models. Because of this, a consumer in possession of two or more generations of a particular electronic device may have to keep on hand an assortment of redundant but incompatible power or data cables that otherwise have essentially the same functionality.

For example, many older digital video cameras rely on cables with HDMI (High-Definition Multimedia Interface) Type C receptacle and plug connectors for transmitting uncompressed digital data to a television or computer, while newer digital video cameras are configured for HDMI Type D connectors, and future generations of digital video camera could potentially be configured for other connector configurations. Consequently, a user of two or more generations of digital video devices may be forced to rely on multiple connector cables that have redundant power supply or data transfer functionality, but incompatible plugs and receptacle connectors. Because the HDMI connectors of these different cables are not interchangeable with each other, the user may be forced to maintain a dedicated set of cables for each generation of video camera, computer, and/or television owned, which is inconvenient, cumbersome, and frustrating. The numerous configurations of USB connector types commonly available to consumers, i.e., the standard, mini, and micro versions, create a similar situation for consumers.

Adaptors between different plug and receptacle sizes of the same type of cable are known. However, such adaptors are generally quite small and therefore easily misplaced or lost, making any data or power cable system that relies on the occasional use of such adaptors inherently unreliable, since a conventional data or power cable system will not be compatible with each intended connector configuration when the necessary adaptor has been misplaced.

Accordingly, there is a need in the art for a cable system that can reliably and conveniently service electronic devices having more than one configuration of receptacle and plug connector.

BRIEF DESCRIPTION OF THE DRAWINGS

So that the manner in which the above recited features of the present invention can be understood in detail, a more particular description of the invention may be had by reference to example embodiments, some of which are illustrated in the appended drawings. It is to be noted, however, that the appended drawings illustrate only example embodiments of this invention and are therefore not to be considered limiting of its scope, for the invention may admit to other equally effective embodiments.

For clarity, identical reference numbers have been used, where applicable, to designate identical elements that are common between figures. It is contemplated that features of one example embodiment may be incorporated in other example embodiments without further recitation.

DESCRIPTION OF EXAMPLE EMBODIMENTS

In the following description, numerous specific details are set forth to provide a more thorough understanding of various embodiments of the invention. However, it will be apparent to one of skill in the art that certain embodiments of the invention may be practiced without one or more of these specific details. In other instances, well-known features have not been described in order to avoid obscuring the invention.

Overview

One example embodiment of the present invention sets forth an electrical cable system that includes a cable body, an electrical connector that has a first electrical connection configuration and is disposed on an end of the cable body, an electrical connection adaptor having a first side compatible with the first electrical connection configuration and a second side compatible with a second electrical connection configuration, and an electrical connection adaptor configured to mechanically couple to the cable body.

Another example embodiment of the present invention sets forth an electrical cable system that includes a cable body, an electrical connector that has a first electrical connection configuration and is disposed on an end of the cable body, an electrical connection adaptor having a first side compatible with the first electrical connection configuration and a second side compatible with a second electrical connection configuration, and a tethering element that attaches the electrical connection adaptor to the cable body.

Yet another example embodiment of the present invention sets forth an electrical cable system that includes a cable body, an electrical connector that has a first electrical connection configuration and is disposed on an end of the cable body, an electrical connection adaptor having a first side compatible with the first electrical connection configuration and a second side compatible with a second electrical connection configuration, and clasping features that are disposed on the electrical connection adaptor and configured to mechanically couple to the cable body when the electrical connection adaptor is detached from the electrical connector.

DETAILED DESCRIPTION OF THE FIGURES

Figures 1, 2, 3:
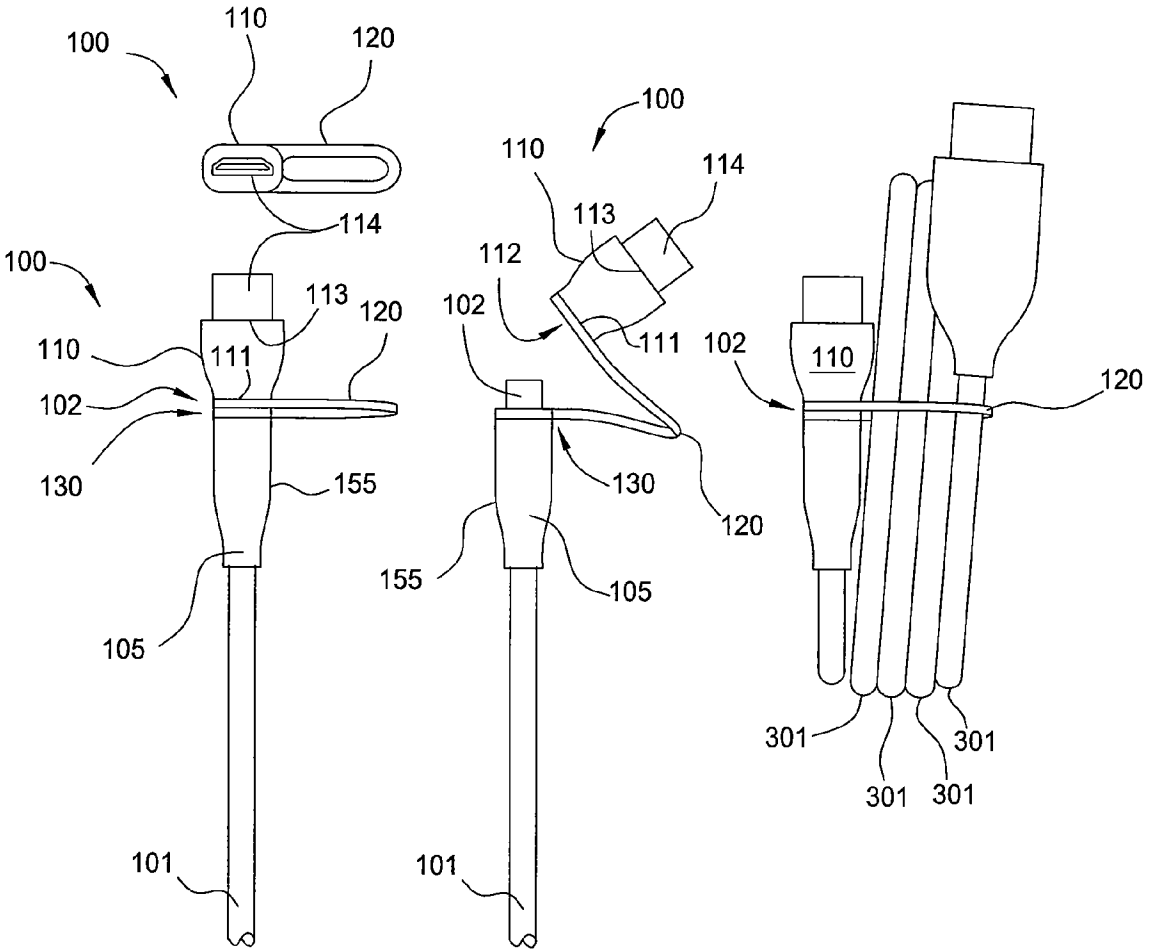
FIG. 1 schematically illustrates side and end views of a cable system with an integrated adaptor attached with a tethering element, according to an example embodiment of the invention.
FIG. 2 schematically illustrates the cable system in FIG. 1 with an integrated adaptor detached from an end connector, according to an example embodiment of the invention.
FIG. 3 schematically illustrates the cable system in FIG. 1, where the tethering element is used as a cable management device, according to an example embodiment of the invention.

FIG. 1 schematically illustrates side and end views of a cable system 100 with an integrated adaptor 110 attached with a tethering element 120, according to an example embodiment of the invention. Cable system 100 may be configured as a data cable, a power-delivering cable, or a combination of both, and includes a cable body 101, a connector head 105 disposed at one or both ends of cable body 101, and a suitable end connector 102 disposed on connector head 105. Examples of different configurations of cable 100 include an AC or DC power cable, an audio, video, and/or telephony signal cable, a USB (universal serial bus) cable, and a digital data cable, such as a SCSI, Category 5, or Category 6 cable. In the example embodiment illustrated in FIG. 1, end connector 102 is an HDMI (High-Definition Multimedia Interface) Type D plug connector configured to mate with an HDMI Type D receptacle connector. Cable body 101 includes one or more conductors, which may be signal- or power-delivering conductors, and an outer dielectric layer, that electrically insulates and protects the conductors from the surroundings.

Tethering element 120 mechanically couples integrated adaptor 110 to cable body 101 or to connector head 105, so that integrated adaptor 110 cannot be lost or misplaced when removed from end connector 102. Consequently, integrated adaptor 110 is mechanically coupled to cable body 101 even when integrated adaptor 110 is not in use. In some example embodiments, tethering element 120 may be formed from an elastic material to facilitate its use as a cable management device. An example embodiment in which tethering element 120 is used as a cable management device is described below in conjunction with FIG. 3.

In some example embodiments, tethering element 120 is permanently attached to connector head 105, end connector 102 and/or integrated adaptor 110, e.g., glued or welded. In other example embodiments, tethering element 120 may be removable from its attachment point 130 to cable system 100, i.e., connector head 105 or end connector 102. For example, tethering element 120 may be stretched onto the attachment point 130 with end connector 102 or connector head 105, and can be removed when desired by a user. Similarly, tethering element 120 may be removable from integrated adaptor 110. In some example embodiments, tethering element 120 is fixed to connector head 105 such that tethering element 120 does not significantly project from an outer surface 155 of connector head 105, i.e., tethering element 120 is substantially flush with outer surface 155. In this way, the outer diameter of end connector 102 and/or integrated adaptor 110 is not increased when tethering element 120 is attached thereto. For example, an annular groove formed in the outer diameter of end connector 102 allows the attachment of tethering element 120 around the outer diameter of end connector 102 without increasing the outer diameter of end connector 102, thereby preventing clearance problems when multiple cables are coupled to closely spaced electrical connectors on a single device. In some example embodiments, tethering element 120 is attached to end connector 102 and integrated adaptor 110 as shown in FIG. 1. In other example embodiments, tethering element 120 may be attached to cable body 101. In either case, integrated adaptor 110 is tethered in some way to cable system 100, and therefore cannot be lost or misplaced when end connector 102 is coupled to another electrical connector and integrated adaptor 110 is not in use.

Integrated adaptor 110 includes a first side 111 configured with an electrical connector 112 compatible for coupling with end connector 102 and a second side 113 configured with an electrical connector 114. Electrical connector 114 is selected to couple with a desired electrical connector that shares some or all of the electrical functionality of end connector 102, but has a different form factor from end connector 102. For example, in FIG. 1, end connector 102 is an HDMI Type D plug connector, electrical connector 112 on first side 111 is an HDMI Type D receptacle connector, and electrical connector 114 on second side 113 is an HDMI Type C plug connector. Thus, when integrated adaptor 110 is mechanically and electrically coupled to end connector 102, as shown in FIG. 1, cable system 100 may be connected to any HDMI Type C receptacle connector. When integrated adaptor 110 is detached from end connector 102, as shown in FIG. 2, cable system 100 may be connected to any HDMI Type D receptacle connector. Thus, cable system 100 is compatible with two different electrical connector configurations. Similarly, integrated adaptor 110 can be used to expand the compatibility of other types of cables as well, including USB cables, power cables, and the like.

FIG. 2 schematically illustrates the cable system in FIG. 1 with integrated adaptor 110 detached from end connector 102, according to one example embodiment of the invention. When integrated adaptor 110 is detached as shown, end connector 102 may be used to electrically couple to a desired electrical connector. As noted above, tethering element 102 prevents integrated adaptor 110 from being lost or misplaced when detached.

FIG. 3 schematically illustrates the cable system in FIG. 1, where tethering element 120 is used as a cable management device, according to one example embodiment of the invention. In such an example embodiment, tethering element 120 secures multiple loops 301 of cable body 101 when wrapped around loops 301 and integrated adaptor 110 is coupled to end connector 102. Such an example embodiment facilitates the portability of cable system 100 by making the system less cumbersome and tangle-free when being transported. In FIG. 3, tethering element 120 is configured for bundling four loops 301 of cable body 101. For different length cable systems, the length of tethering element 120 may be selected to bundle an optimal number of loops. For example, for longer cables, cable body 101 is optimally coiled into a larger number of loops, and the length of tethering element 120 may be selected accordingly.

Figure 4:
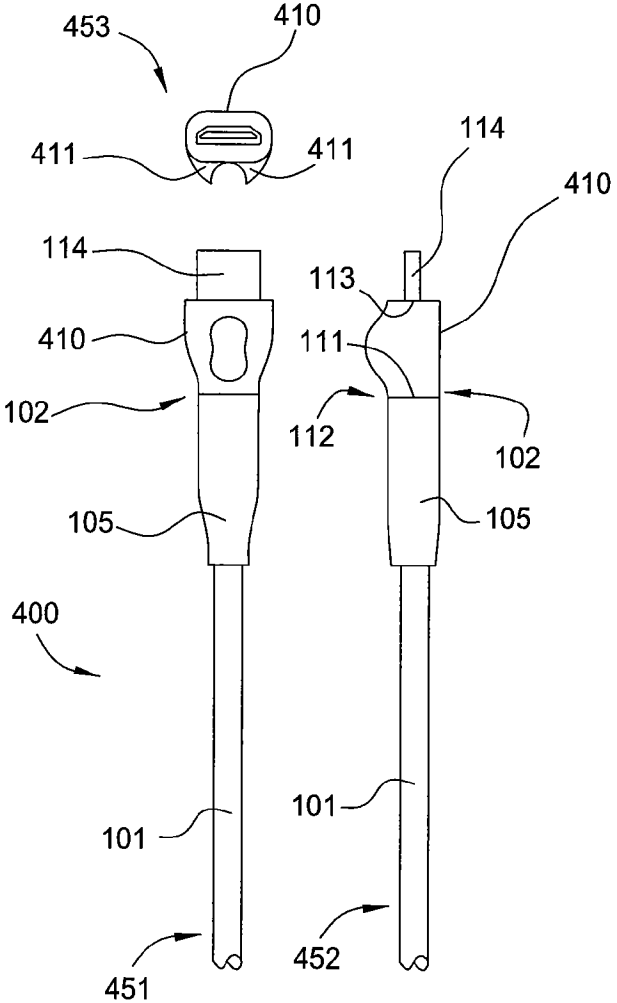
FIG. 4 schematically illustrates three orthogonal views of a cable system with an integrated adaptor, according to a different example embodiment of the invention.

FIG. 4 schematically illustrates three orthogonal views of a cable system 400 with an integrated adaptor 410, according to a different example embodiment of the invention. Cable system 400 includes integrated adaptor 410 and cable body 101, connector head 105, and end connector 102. Top view 451 and side view 452 show integrated adaptor 410 coupled to end connector 102, and end view 453 shows integrated adaptor 410 and clasping features 411 formed thereon.

Integrated adaptor 410 is substantially similar in functionality to integrated adaptor 110 in FIG. 1, except for the way in which integrated adaptor 410 is mechanically coupled to cable body 101. Integrated adaptor 410 includes first side 111 configured with electrical connector 112, which is compatible for coupling with end connector 102, and second side 113 configured with electrical connector 114. By way of example, in FIG. 4 end connector 102 is depicted as an HDMI Type D plug connector, electrical connector 112 is depicted as an HDMI Type D receptacle connector, and electrical connector 114 is depicted as an HDMI Type C plug connector. Clasping features 411 are configured to mechanically couple integrated adaptor 410 to cable body 101 as a storage scheme for integrated adaptor 410 when not in use. For example, clasping features 411 may be gripping fingers configured to pinch cable body 101 when mechanically coupled thereto. When clasping features 411 are gripping fingers configured to pinch cable body 101, they may form an opening having a cross-section that corresponds to the cross-section of cable body 101. For example, as shown in end view 453, clasping features 411 form an opening that is substantially semicircular in cross-section in order to pinch cable body 101, which in FIG. 4 is circular in cross-section. In other example embodiments, the cross-section of cable body 101 may be other than circular, such as in the case of power and data transfer cables having a flat configuration, and the opening formed by clasping features 411 is configured accordingly. In some example embodiments, clasping features 411 are features formed as part of the body of integrated adaptor 410. In other example embodiments, clasping features are formed from a different material than integrated adaptor 410 and are separate components that are attached to the body of integrated adaptor 410. In some example embodiments, clasping features 411 are formed from an elastic material, such as an elastic polymer or rubber-containing material, in order to produce a stronger grip on cable body 101 when integrated adaptor 410 is mechanically coupled thereto.

Figures 5, 6:
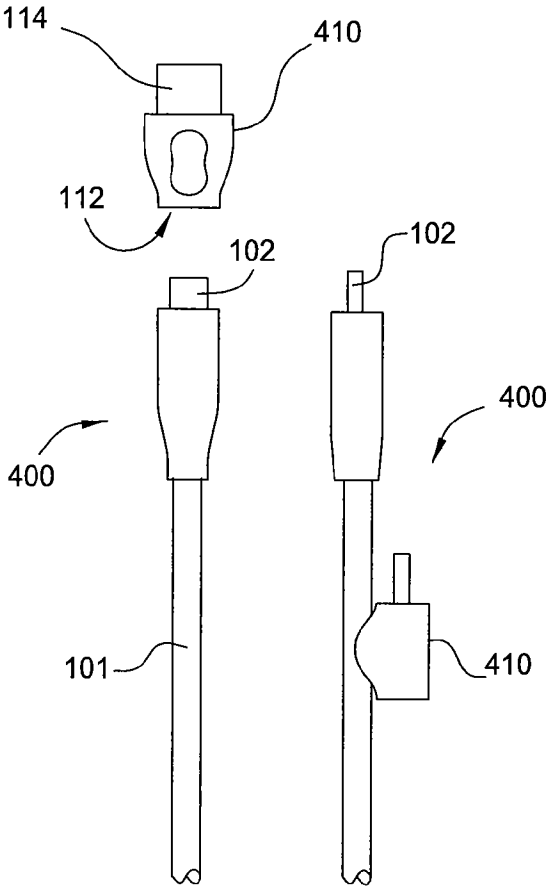
FIG. 5 schematically illustrates a top view of the cable system in FIG. 4, in which the integrated adaptor has been removed from an end connector.
FIG. 6 schematically illustrates a side view of the cable system in FIG. 4, in which the integrated adaptor has been mechanically coupled to a cable body as a storage scheme for the integrated adaptor when the integrated adaptor is not in use.

FIG. 5 schematically illustrates a top view of the cable system in FIG. 4, in which integrated adaptor 410 has been removed from end connector 102. As shown, removal of integrated adaptor 410 reveals end connector 102, thereby making cable system 400 compatible for electrical and mechanical coupling to an HDMI Type D receptacle connector. FIG. 6 schematically illustrates a side view of the cable system in FIG. 4, in which integrated adaptor 410 has been mechanically coupled to cable body 101 as a storage scheme for integrated adaptor 410 when integrated adaptor 410 is not in use. Thus, cable system 400 is compatible with two different electrical connector configurations, and integrated adaptor 410 can be conveniently stored in a fashion that prevents loss thereof.

Figure 7:
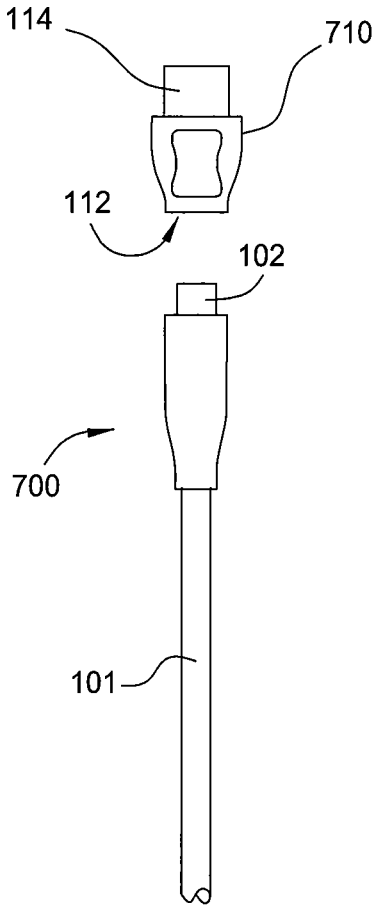
FIG. 7 schematically illustrates a top view of a cable system in which an integrated adaptor has been removed from an end connector of a cable system.
Figure 8:
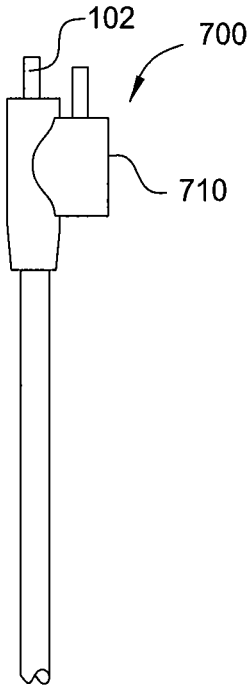
FIG. 8 schematically illustrates a side view of a cable system in which an integrated adaptor is mechanically coupled to a connector head of a cable system.

In some embodiments, an integrated adaptor has clasping features configured to mechanically couple the integrated adaptor to a connector head of a cable system rather than to the cable body of the cable system. FIG. 7 schematically illustrates a top view of a cable system 700 in which an integrated adaptor 710 has been removed from end connector 102 of cable system 700. FIG. 8 schematically illustrates a side view of cable system 700 in which integrated adaptor 710 is mechanically coupled to connector head 105 of cable system 700. Integrated adaptor 710 is substantially similar in organization and operation to integrated adaptor 410 in FIGS. 4-6, except that integrated adaptor 710 has clasping features 711 configured to mechanically couple integrated adaptor 710 to connector head 105 of cable system 700.

In sum, example embodiments of the invention provide power and data cable systems with integrated adaptors. By configuring an electrical connection adaptor for a cable system to be mechanically coupled to the cable system when the adaptor is not in use, the adaptor is always advantageously located for use and cannot be lost. In some example embodiments, a further advantage is that a tethering element can also serve as a cable management device.

While the foregoing is directed to certain example embodiments of the present invention, other and further embodiments of the invention may be devised without departing from the basic scope thereof. Therefore, the scope of the present invention is determined by the claims that follow.

We claim:

1. A system, comprising:

a cable body;

an electrical connector having a first male connection interface that has a first electrical connection configuration and is disposed on an end of the cable body, wherein the first electrical connection configuration comprises a power based configuration;

an electrical connection adaptor having a female connection interface that is compatible with the first electrical connection configuration of the first male connection interface and a second male connection interface that has a second electrical connection configuration that is different from the first electrical connection configuration, wherein the electrical connection adaptor is further configured to mechanically couple to the cable body;

a connector head coupled to the cable body and the electrical connector; and a tethering element that attaches the electrical connection adaptor to the connector head, wherein a first end of the tethering element is connected to a side of the connector head that is opposite of a side of the electrical connection adaptor connected to a second end of the tethering element when the tethering element is fixed to the electrical connector, and wherein, when the electrical connection adaptor is fixed to the electrical connector, the tethering element forms an aperture configured such that multiple coils of the cable body may be bundled together within the aperture.

2. The system of claim 1, wherein the power-based configuration delivers DC or AC power for powering a device connected to the electrical connection adaptor.

3. A system, comprising:

a cable body;

an electrical connector having a first male connection interface that has a first electrical connection configuration and is disposed on an end of the cable body;

an electrical connection adaptor having a female connection interface that is compatible with the first electrical connection configuration of the first male connection interface and a second male connection interface that has a second electrical connection configuration;

a connector head coupled to the cable body and the electrical connector; and a tethering element that attaches the electrical connection adaptor to the connector head, wherein a first end of the tethering element is connected to a side of the connector head that is opposite of a side of the electrical connection adaptor connected to a second end of the tethering element when the tethering element is fixed to the electrical connector, and wherein, when the electrical connection adaptor is fixed to the electrical connector, the tethering element forms an aperture configured such that multiple coils of the cable body may be bundled together within the aperture.

4. The system of claim 3, wherein the tethering element is detachable from the electrical connection adaptor and/or the cable body.

5. The system of claim 3, wherein the tethering element is comprised of an elastic material.

6. The system of claim 3, wherein the cable body includes a connector head and the electrical connector is disposed on an end of the connector head.

7. The system of claim 6, wherein the tethering element is attached to the connector head and is configured to be substantially flush with an outer surface of the connector head.

8. The system of claim 7, wherein the outer surface of the connector head is configured with a groove as an attachment point for the tethering element.

* * * * *